US009696117B2

(12) United States Patent
Miller

(10) Patent No.: US 9,696,117 B2
(45) Date of Patent: Jul. 4, 2017

(54) MISSILE SEEKERS

(71) Applicant: MBDA UK Limited, Stevenage, Hertfordshire (GB)

(72) Inventor: Lee Douglas Miller, Bristol South Gloucestershire (GB)

(73) Assignee: MBDA UK LIMITED, Stevenage, Hertfordshire (GB)

( * ) Notice: Subject to any disclaimer, the term of this patent is extended or adjusted under 35 U.S.C. 154(b) by 0 days.

(21) Appl. No.: 14/898,173

(22) PCT Filed: Jun. 12, 2014

(86) PCT No.: PCT/GB2014/051806
§ 371 (c)(1),
(2) Date: Dec. 14, 2015

(87) PCT Pub. No.: WO2014/199162
PCT Pub. Date: Dec. 18, 2014

(65) Prior Publication Data

US 2016/0131456 A1 May 12, 2016

(30) Foreign Application Priority Data

Jun. 14, 2013 (GB) ..... 1310916.0

(51) Int. Cl.
*F41G 7/22* (2006.01)
*H01Q 19/19* (2006.01)
(Continued)

(52) U.S. Cl.
CPC ..... *F41G 7/008* (2013.01); *F41G 7/228* (2013.01); *F41G 7/2253* (2013.01);
(Continued)

(58) Field of Classification Search
CPC ..... H01Q 19/10; H01Q 19/18; H01Q 19/19; H01Q 19/191; F41G 7/008; F41G 7/20;
(Continued)

(56) References Cited

U.S. PATENT DOCUMENTS 2,972,743 A 2/1961 Svensson et al.
3,165,749 A 1/1965 Cushner
(Continued)

FOREIGN PATENT DOCUMENTS

FR 2944594 A1 10/2010
WO WO 2011/129856 A2 10/2011

OTHER PUBLICATIONS

International Preliminary Report on Patentability and Written Opinion dated Dec. 23, 2015 issued in PCT/GB2014/051806.
(Continued)

*Primary Examiner* — Bernarr Gregory
(74) *Attorney, Agent, or Firm* — Scully, Scott, Murphy & Presser, PC

(57) ABSTRACT

A sensor for a missile seeker includes a primary, concave, reflector that is reflective to RF waves and to another kind of waves, but that includes a transmissive region, through which RF waves can pass. A secondary, convex, reflector is reflective to RF waves but transmissive, and not reflective, to the other kind of waves, and is arranged facing the primary reflector to further reflect RF waves reflected by the primary reflector through the transmissive region of the primary reflector. An RF detector is arranged on the opposite side of the primary reflector from the secondary reflector and arranged to detect the RF waves reflected by the secondary reflector through the transmissive region of the primary reflector. A second detector, for detecting the other kind of waves, is arranged on the opposite side of the secondary reflector from the primary reflector and is arranged to detect
(Continued)

the other kind of waves after they are reflected by the primary reflector and transmitted through the secondary reflector.

16 Claims, 3 Drawing Sheets

(51) Int. Cl.
*F41G 7/00* (2006.01)
*H01Q 19/00* (2006.01)

(52) U.S. Cl.
CPC ..... *F41G 7/2286* (2013.01); *F41G 7/2293* (2013.01); *H01Q 19/191* (2013.01)

(58) Field of Classification Search
CPC ..... F41G 7/22; F41G 7/2253; F41G 7/2273; F41G 7/228; F41G 7/2286; F41G 7/2293; F24J 2/04; F24J 2/06; G01S 17/88
See application file for complete search history.

(56) References Cited

U.S. PATENT DOCUMENTS 3,935,818 A * 2/1976 Johnson ..... F41G 7/2253 102/213
4,866,454 A 9/1989 Droessler et al.
5,075,680 A 12/1991 Dabbs
5,135,183 A * 8/1992 Whitney ..... F41G 7/2293 244/3.16
5,149,970 A * 9/1992 Whitney ..... F41G 7/2253 250/226
5,182,564 A * 1/1993 Burkett ..... F41G 7/008 342/53
5,327,149 A * 7/1994 Kuffer ..... F41G 7/2253 342/53
5,826,820 A * 10/1998 Dubois ..... F41G 7/2253 244/3.16
6,252,559 B1 * 6/2001 Donn ..... H01Q 19/19 343/756
6,268,822 B1 7/2001 Sanders et al.
6,741,341 B2 * 5/2004 DeFlumere ..... F41G 7/008 250/203.6
7,183,966 B1 2/2007 Schramek et al.
7,786,418 B2 * 8/2010 Taylor ..... F41G 7/008 244/3.1
7,952,688 B2 * 5/2011 Paiva ..... G01S 17/88 356/4.01
8,283,554 B2 * 10/2012 Bruning ..... F24J 2/06 136/246
8,829,404 B1 * 9/2014 Rinker ..... F41G 7/008 250/203.1
2005/0093757 A1 5/2005 Kiernan et al.
2010/0108800 A1 * 5/2010 Mayer ..... F41G 7/008 244/3.16
2010/0127113 A1 5/2010 Taylor et al.
2012/0080552 A1 4/2012 Taylor et al.

OTHER PUBLICATIONS

International Search Report and Written Opinion dated Sep. 12, 2014 issued in PCT/GB2014/051806.
GB Search Report dated Dec. 10, 2013 issued in GB1310916.0.
English Abstract of GB 2469736 A, dated Oct. 27, 2010.

* cited by examiner

MISSILE SEEKERS

FIELD OF THE INVENTION

This invention relates to the field of missile seekers. The invention relates in particular to a sensor for a missile seeker, the sensor being a multiband sensor, able to detect radio-frequency (RF) radiation and radiation of at least one other kind.

BACKGROUND ART

Homing missiles include a seeker of some kind, to indicate the direction of a target. The seeker will include a sensor, which will be sensitive to radiation emitted by, or reflected from, the target. Different kinds of radiation can provide different information about a target. For example, radar can give very accurate information about range to a target, but to obtain angular information from radar reflections requires more complex equipment and processing. Also, sensors for detecting different kinds of radiation perform differently in different environmental conditions and over different ranges; for example, infrared (IR) radiation can provide images as well as positional and directional information, but has a shorter range than radar and can be adversely affected by poor weather conditions. It is known to provide multiband sensors, which take advantage of the complementary nature of different kinds of radiation by detecting RF radiation and also electromagnetic radiation of at least one other waveband, for example near IR.

A well-known arrangement for a sensor is the Cassegrain telescope. A Cassegrain telescope comprises two focusing mirrors having a common centre of curvature. One of the mirrors—the primary mirror—is concave, with its focus at the common centre of curvature. The primary mirror has a transparent region or a hole its centre. The other mirror—the secondary mirror—is arranged between the primary mirror and the common centre of curvature and is convex, facing towards the primary mirror and away from the common centre of curvature. The secondary mirror has a virtual focus at the common centre of curvature (i.e. parallel rays striking the secondary mirror are reflected as divergent rays appearing to originate at the common centre of curvature). Radiation striking the primary mirror is focused towards the secondary mirror, which in turn focuses the radiation through the transparent region or hole in the primary mirror, towards a radiation detector arranged behind the primary mirror.

Several multiband sensors for missile seekers have been proposed in the prior art. For example, U.S. Pat. No. 2,972,743 (Svensson et al.) describes a multiband sensor in which a Cassegrain telescope is provided for the detection of infrared radiation, but which also includes an RF sensing subsystem in the form of an RF reflector, which focuses incoming RF radiation onto a RF detector. The RF reflector is arranged between the primary and secondary mirrors of the Cassegrain telescope, but transmits IR radiation as it is in the form of a wire mesh. The RF reflector is mounted with and coaxial to the secondary reflector.

U.S. Pat. No. 3,165,749 (Cushner) describes a multiband sensor in which a Cassegrain telescope is again provided for the detection of infrared radiation. An IR imager is provided. In this arrangement, the primary mirror reflects RF radiation as well as IR radiation. The secondary mirror is reflective to IR but transmissive to RF, and an RF horn is positioned behind the secondary mirror. A similar arrangement is described in U.S. Pat. No. 4,866,454 (Droessler et al.). US 2010/0127113A1 (Taylor et al.) describes another similar system also including baffles to block unwanted sunlight from reaching the IR detector. US 2012/0080552A1 (Taylor et al.) describes another similar system in which the secondary mirror is a molded mirror.

U.S. Pat. No. 7,183,966 (Schramek et al.) describes examples of multiband sensors that detect microwave radiation and light-wave radiation a first frequency and a second frequency. The sensors described include a Cassegrain telescope for the light-wave radiation. The primary mirror of the Cassegrain telescope is transparent to the microwave radiation. A system is described that includes, in addition to an RF detector, detectors for detecting pulses of radiation generated by a semi-active laser (SAL) system and for detecting images formed by radiation generated by a semi-active laser system and images formed by IR radiation. Three paths are provided for the IR radiation: Cassegrain telescope arrangements for SAL imaging and IR imaging, and a form of folded-Cassegrain telescope arrangement for SAL pulse detection. In the SAL pulse detector, the secondary mirror directs the SAL pulses to a plane mirror, which directs them back through an aperture at the centre of the secondary mirror to an avalanche photodiode or other detector behind the secondary mirror. The RF radiation is essentially independent of the IR Cassegrain telescopes.

The amount of space in a missile is limited. It is desirable to include further detectors or other apparatus in the missile, whilst keeping the space taken up by the detectors small.

It would be advantageous to provide a sensor for a missile seeker in which one or more of the aforementioned disadvantages is eliminated or at least reduced.

DISCLOSURE OF THE INVENTION

A first aspect of the invention provides a sensor for a missile seeker, the sensor comprising:

a primary, concave, reflector that is reflective to RF waves and to another kind of waves, but that includes a transmissive region, through which RF waves can pass;

a secondary, convex, reflector that is reflective to RF waves but transmissive, and not reflective, to the other kind of waves, and is arranged facing the primary reflector to further reflect RF waves reflected by the primary reflector through the transmissive region of the primary reflector;

an RF detector for detecting RF waves, arranged on the opposite side of the primary reflector from the secondary reflector and arranged to detect the RF waves reflected by the secondary reflector through the transmissive region of the primary reflector; and a second detector, for detecting the other kind of waves, the second detector being arranged on the opposite side of the secondary reflector from the primary reflector and being arranged to detect the other kind of waves after they are reflected by the primary reflector and transmitted through the secondary reflector.

Thus, the invention provides a multimode sensor including a Cassegrain telescope in which the primary reflector is reflective of both RF and another kind of waves and the secondary reflector is reflective of RF but not the other kind of waves. An RF detector is arranged behind the primary reflector and detects RF waves that have passed through the transmissive region of the primary detector, and a detector of the other kind of waves is arranged behind the secondary reflector and detects waves that have passed through the secondary reflector.

Note that, in contrast to the present invention, multimode sensors in the prior art have generally provided an RF detector at the location of the secondary reflector. The skilled person would understand that to be the logical way to construct a sensor. There is a prejudice in the art against putting a detector of other waves, for example an IR detector, at the location of the secondary reflector, as the Cassegrain telescope arrangement results in only a very narrow effective field of view at that location, typically only about +/−2 degrees. At greater angles, optical aberrations result from reflections from towards the edge of the primary reflector. However, the inventor has recognised that in some applications that limited field of view is not problematic, and also that, in some applications, the RF detector can be used to provide coarse steering of the sensor, so that the available effective field of view of the second detector is adequate. Arranging the second detector behind the secondary reflector is advantageous because the optical path to the detector of the other kind of waves is lower loss than in many prior-art arrangements. For example, in many prior-art arrangements, the other kind of waves pass through RF components; transmissivity can be as low as 20%. Although U.S. Pat. No. 7,183,966 (Schramek et al.) describes a multiband sensor in which SAL pulses are detected behind the secondary mirror, the pulses reach the detector only after additional reflections, from the secondary mirror and a plane mirror, and those additional reflections will introduce further losses and make optical alignment more difficult. In the present arrangement, the other kind of waves encounter only a small number of potential sources of loss. For example, in embodiments of the invention, once the other kind of waves have passed through the radome of the missile, there is only one reflection (from the primary reflector) and one transmission (through the secondary reflector) before the second detector is reached. The inventor calculates that losses to the other kind of waves in the arrangement of the invention can be as low as 20% or less. Such a transmissivity, of 80%, can double the range of the detector.

It may be that the other kind of waves is an electromagnetic (EM) wave, for example an EM wave in the optical part of the EM spectrum. It may be that the other kind of waves is an EM wave in the visible region of the EM spectrum. It may be that the other kind of waves is an EM wave in the IR region of the EM spectrum, for example near IR or thermal IR. It may be that the other kind of waves is an acoustic wave.

It may be that the primary reflector and the secondary reflector have a common centre of curvature.

It may be that the primary reflector has the shape of part of the surface of a paraboloid. It may be that the secondary reflector has the shape of part of the surface of a paraboloid.

It may be that the primary reflector includes an RF mesh. It may be that the primary reflector includes a coating that reflects the other kind of waves.

It may be that the secondary reflector comprises an RF mesh. It may be that the secondary reflector is on the front surface of a convex solid supporting structure, which may for example be a convex glass block. It may be that the second detector is mounted on the solid supporting structure, for example it may be bonded to the solid supporting structure. It may be that the secondary reflector comprises an RF reflection coating.

It may be that the second detector includes a pre-amplifier, which may be configured to provide a detection signal to signal processing equipment located within the missile.

It may be that the other kind of waves originates from a laser designator, for example at 1064 nm.

It may be that the second detector is a quadrant detector. It may be that the second detector is an imager, e.g. a camera or an imaging array.

It may be that the second detector is an intensity detector. In an example embodiment, the second detector is used as both a quadrant detector lo and an intensity detector, with the output of the quadrant detector being integrated to provide a measure of total intensity.

It may be that the sensor includes LADAR apparatus, and the second detector is a detector of the LADAR apparatus, for example at 1064 nm or 1550 nm. An intensity detector is sufficient for a LADAR detector.

It may be that the concave primary reflector focuses the other kind of waves on the second detector. Alternative, it may be that the other kind of waves is out of focus at the second detector. It may be that the second detector detects the total intensity of the other kind of waves. It may be that the sensor includes an imager. It may be that the imager includes or is connected to an image processor and the second detector is configured to provide an out-of-focus image of the other kind of waves to the imager, the image processor being configured to sharpen in software the out-of-focus image. In some embodiments, for example when the second detector is detecting waves from a semi-active laser designator, it may be advantageous for the other kind of waves to be out of focus on the second detector, for example in the case of a quadrant detector which requires a reasonably large spot.

It may be that the other kind of waves comprises two or more wavelengths. The second detector may then be a two (or more) colour detector.

It may be that the RF waves comprise two or more carrier wavelengths.

It may be that the primary reflector is reflective of, the secondary reflector is transmissive of, and the second detector is arranged to detect, at least one further other kind of wave. It may be that the further kind of waves is an electromagnetic (EM) wave, for example an EM wave in the optical part of the EM spectrum. It may be that the further kind of waves is an EM wave in the visible region of the EM spectrum. It may be that the further kind of waves is an EM wave in the IR region of the EM spectrum, for example near-IR or thermal-IR. It may be that the further kind of waves is an acoustic wave.

It may be that a third detector for detecting yet another kind of waves is provided behind the primary reflector. It may be that the yet another kind of waves is an electromagnetic (EM) wave, for example an EM wave in the optical part of the EM spectrum. It may be that the yet another kind of waves is an EM wave in the visible region of the EM spectrum. It may be that the yet another kind of waves is an EM wave in the IR region of the EM spectrum, for example near IR or thermal IR. It may be that the yet another kind of waves is an acoustic wave.

It may be that the transmissive region of the primary reflector is an aperture or hole. Alternatively, it may be that the transmissive region of the primary reflector is a solid region that is transparent or substantially transparent to RF waves. It may be that the transmissive region is at the centre of the primary reflector.

It may be that the primary reflector is configured to be steerable when it is mounted inside a missile. It may then be that the secondary reflector is configured to move with the primary reflector as the primary reflector is steered.

An advantage of the invention is that it can free up space in the missile for extra detectors. The sensor may include an additional imager, for example a low-light camera or a thermal imager, for example operating in the mid-IR (3 microns to 5 microns) or the long IR (8 microns to 12 microns).

It will of course be appreciated that features described in relation to one aspect of the present invention may be incorporated into other aspects of the present invention. For example, the method of the invention may incorporate any of the features described with reference to the system of the invention and vice versa.

BRIEF DESCRIPTION OF THE DRAWINGS

Example embodiments of the invention will now be described by way of example only and with reference to the accompanying drawings, of which.

DETAILED DESCRIPTION

Figure 1:
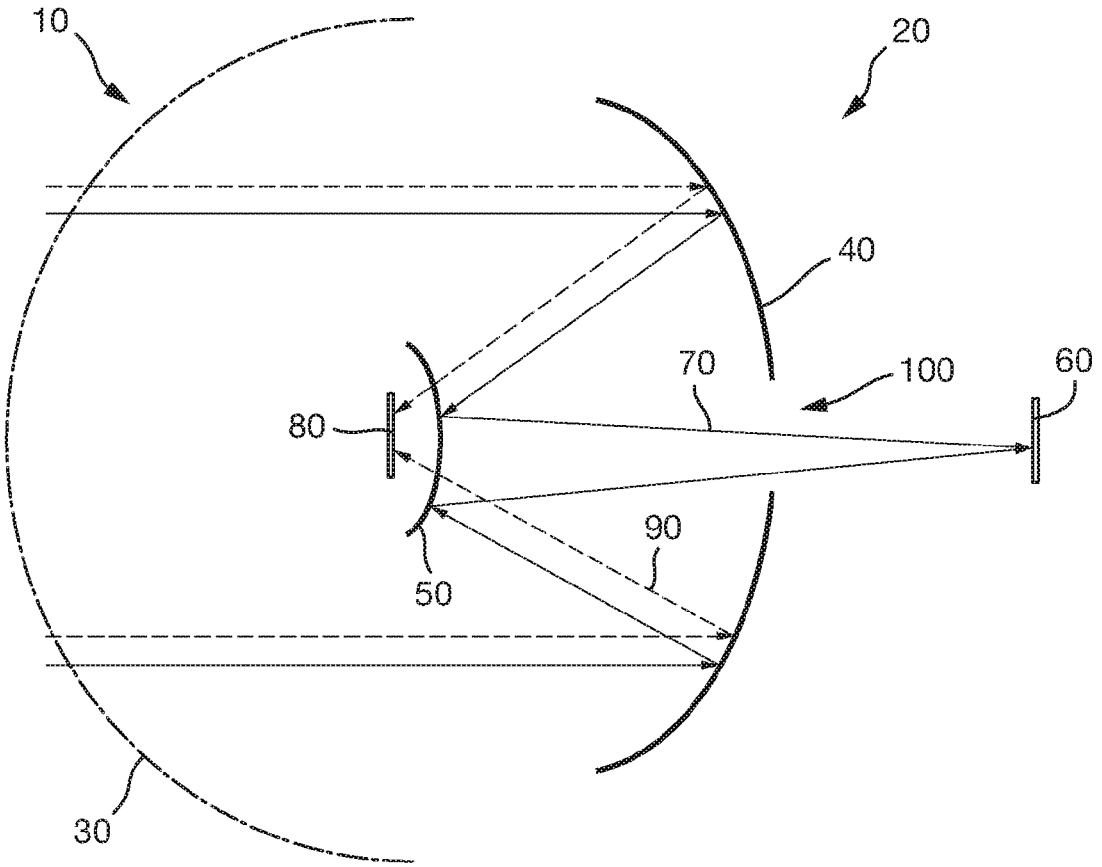
FIG. 1 is a schematic cross-section of the nose region of a missile including a multimode sensor according to an example embodiment of the invention.

In an example embodiment of the invention, the nose region 10 of a missile includes a multimode sensor 20 arranged behind the radome 30 of the missile. The sensor 20 comprises a Cassegrain telescope formed by a primary reflector 40, a secondary reflector 50, an RF detector 60 for detecting RF radiation 70 and an IR detector 80 for detecting IR radiation 90. The primary reflector 40 includes an aperture 100. The RF detector 60 is arranged behind the primary reflector 40. The IR detector 80 is arranged behind the secondary reflector 50.

The secondary reflector 50 is dichroic. It is reflective to RF radiation 70 and transparent to IR radiation 90.

RF radiation 70 incident on the radome 30 passes to the primary reflector 40, is focused towards the secondary reflector 50 and then through the aperture 100 to the RF detector 60. IR radiation 90 incident on the radome 30 also passes to the primary reflector 40 and is focused towards the secondary reflector 50. However, the IR radiation 90 passes through the secondary reflector 50 to the IR detector 80.

In this example embodiment, the IR radiation 90 is generated by a laser designator, and has a wavelength of 1064 nm. The IR detector 80 is a quadrant detector that detects a defocused spot of IR radiation.

Figure 2:
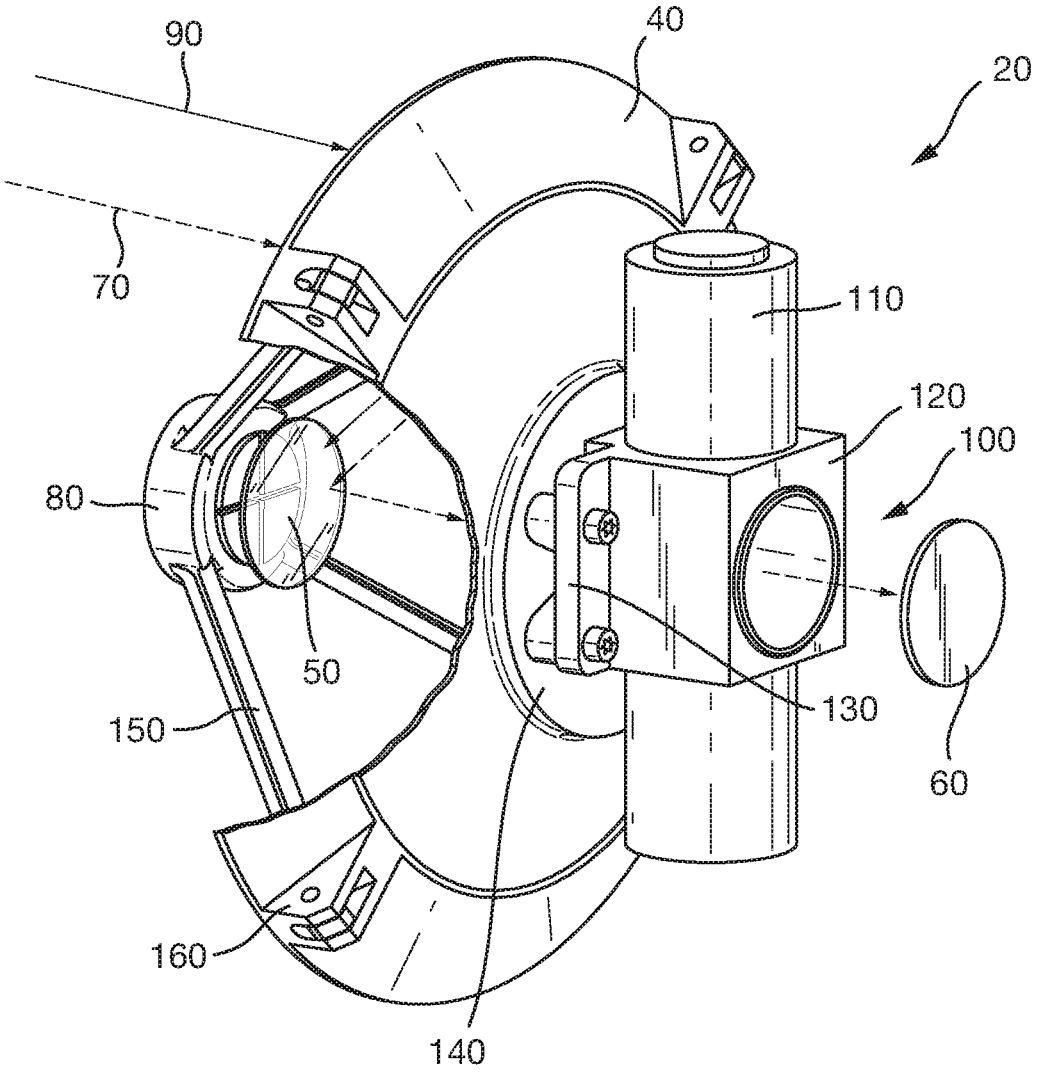
FIG. 2 is a schematic perspective view of the multimode sensor of FIG. 1.

The primary reflector 40 is mounted (FIG. 2) within a missile nose using a support bar 110. The support bar 110 passes through a cuboidal clamp 120, which includes flanges 130. The primary reflector 40 is bolted, via a support disk 140, to the flanges 130 of the clamp 120. The central aperture 100 of the primary reflector 40 extends through the disk 140, bar 110 and clamp 120. The RF detector 60 is independently mounted within the missile nose, behind the bar 110 and coaxial with the primary reflector 40, so that it receives RF waves that pass through the aperture 100. The IR detector 80 is mounted on the primary reflector 40. The IR detector 80 is welded to mounting struts 150, which pass through the periphery of the primary reflector and the other ends of which are retained behind the primary reflector by brackets 160. The secondary reflector 50 is mounted on (or, in some embodiments, close to) the surface of the IR detector 80 that faces the primary reflector 40.

Figure 3:
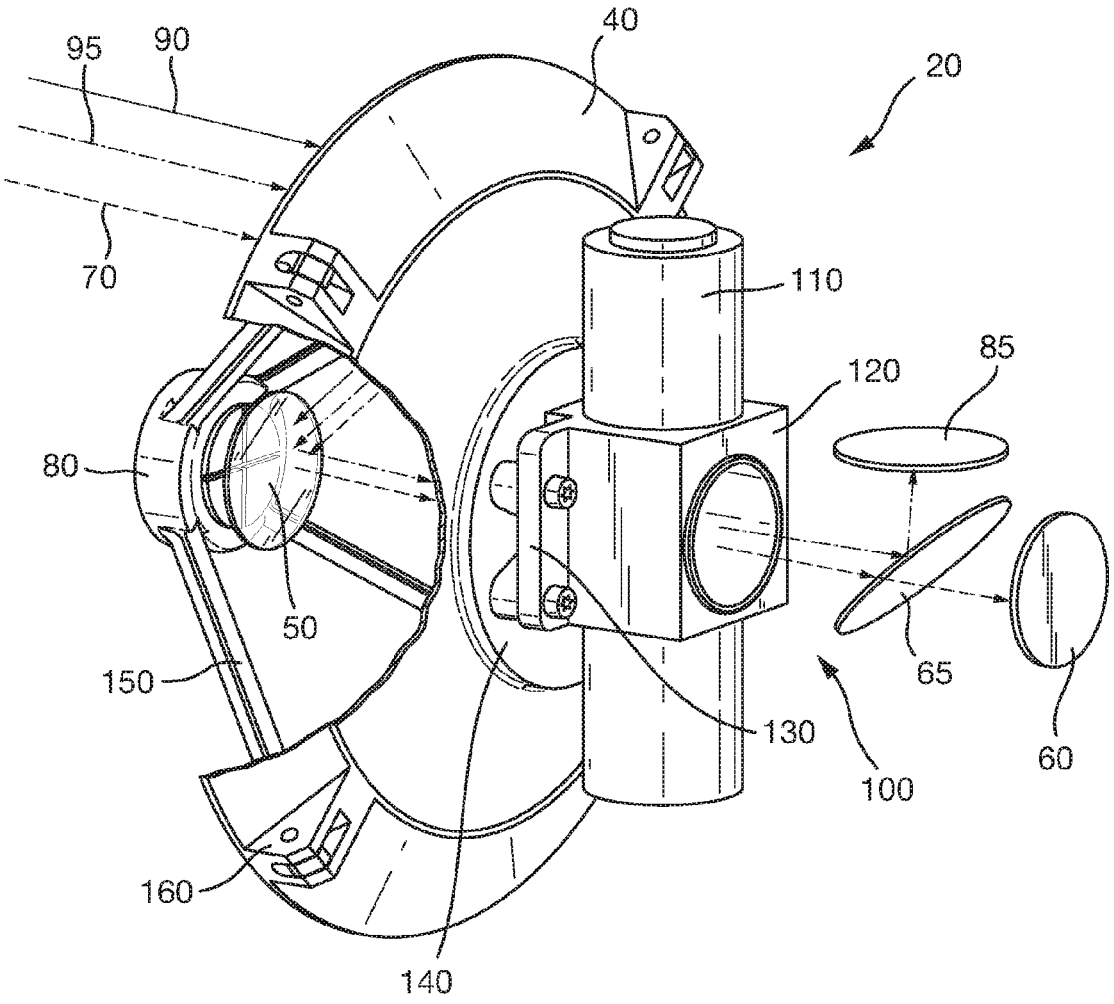
FIG. 3 is a schematic perspective view of a multimode sensor according to another example embodiment of the invention.

In another example embodiment of the invention (FIG. 3), a thermal imager 85 is additionally arranged behind the primary mirror 40. In this embodiment, the IR detector 80 detects near IR radiation. The secondary reflector 50 is reflective to thermal IR radiation 95, as well as RF radiation 70, but is not reflective to near IR radiation 90. A splitter 65 is positioned between the primary reflector 40 and the RF detector 60; it transmits RF radiation 70 to the RF detector but reflects thermal IR radiation 95 to the thermal IR detector 85. Thus, the sensor behaves like that of the embodiment of FIGS. 1 and 2, but additionally provides images in the thermal IR, with the thermal IR radiation 95 following the same path as RF radiation 70 through the Cassegrain telescope formed by the first reflector 40 and the second reflector 50, save that, after passing through the aperture 100, the thermal IR radiation 95 is reflected to the thermal IR imager 85 by the splitter 65.

Whilst the present invention has been described and illustrated with reference to particular embodiments, it will be appreciated by those of ordinary skill in the art that the invention lends itself to many different variations not specifically illustrated herein.

For example, in another example embodiment of the invention, the IR detector 80 is an imaging array positioned so that the IR rays 90 are focused upon it. In another example embodiment of the invention, the IR detector 80 is an imaging array positioned so that the IR rays 90 form an unfocused image upon it; software is employed to sharpen the image.

In example embodiments of the invention, the RF detector 60, the IR detector 80, or both are configured to detect radiation at a plurality of wavelengths; for example, in example embodiments of the invention, the IR detector 80 is a two-colour array.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may be absent in other embodiments.

The invention claimed is:

1. A sensor for a missile seeker, the sensor comprising:

a primary, concave, reflector that is reflective to RF waves and to another kind of waves, but that includes a transmissive region, through which RF waves can pass;

a secondary, convex, reflector that is reflective to RF waves but transmissive to the other kind of waves, and is arranged facing the primary reflector to further reflect RF waves reflected by the primary reflector through the transmissive region of the primary reflector;

an RF detector for detecting RF waves, arranged on the opposite side of the primary reflector from the secondary reflector and arranged to detect the RF waves reflected by the secondary reflector through the transmissive region of the primary reflector; and a second detector, for detecting the other kind of waves, the second detector being arranged on the opposite side of the secondary reflector from the primary reflector and being arranged to detect the other kind of waves after they are reflected by the primary reflector and transmitted through the secondary reflector.

2. A sensor as claimed in claim 1, in which the other kind of waves is an electromagnetic (EM) wave.

3. A sensor as claimed in claim 1, in which the other kind of waves is an acoustic wave.

4. A sensor as claimed in claim 1, in which the secondary reflector is on the front surface of a convex solid supporting structure.

5. A sensor as claimed in claim 1, in which the second detector is a quadrant detector, an imager or an intensity detector.

6. A sensor as claimed in claim 1, in which the sensor includes LADAR apparatus, and the second detector is a detector of the LADAR apparatus.

7. A sensor as claimed in claim 1, in which the concave primary detector focuses the other kind of waves on the second detector.

8. A sensor as claimed in claim 1, in which the other kind of waves is out of focus at the second detector.

9. A sensor as claimed in claim 8, in which the sensor includes an imager and the imager includes or is connected to an image processor and the second detector is configured to provide an out-of-focus image of the other kind of waves to the imager, the image processor being configured to sharpen in software the out-of-focus image.

10. A sensor as claimed in claim 1, in which the other kind of waves comprises two or more wavelengths.

11. A sensor as claimed in claim 1, in which the RF waves comprise two or more carrier wavelengths.

12. A sensor as claimed in claim 1, in which the primary reflector is reflective of, the secondary reflector is transmissive of, and the second detector is arranged to detect, at least one further other kind of wave.

13. A sensor as claimed in claim 1, in which a third detector for detecting yet another kind of waves is provided behind the primary reflector.

14. A sensor as claimed in claim 1, in which the primary reflector is configured to be steerable when it is mounted inside a missile and the secondary reflector is configured to move with the primary reflector as the primary reflector is steered.

15. A sensor as claimed in claim 1, further comprising a low-light camera or thermal imager.

16. A sensor as claimed in claim 15, wherein the thermal imager operates in the mid-IR or the long IR.

* * * * *